US005604325A

United States Patent [19]

Balbo et al.

[11] Patent Number: 5,604,325

[45] Date of Patent: Feb. 18, 1997

[54] CANNON BREECH INCLUDING A BREECH BLOCK TRANSLATABLE BETWEEN TWO CHEEKS OF A BREECH RING, AND CANNON HAVING SUCH A CANNON BREECH

[75] Inventors: Patrick Balbo; Philippe Grelat, both of Bourges; Guy Malassenet, Pigny; Fabienne Mandereau, Sainte Thorette, all of France

[73] Assignee: Giat Industries, Versailles, France

[21] Appl. No.: 439,369

[22] Filed: May 11, 1995

[51] Int. Cl.[6] ..... F41A 3/34

[52] U.S. Cl. ..... 89/24; 42/15

[58] Field of Search ..... 89/22, 23, 24; 42/15, 23

[56] References Cited

U.S. PATENT DOCUMENTS 5,014,592 5/1991 Zweig et al. ..... 89/24

FOREIGN PATENT DOCUMENTS

| | | | |
|---|---|---|---|
| 207748 | 9/1966 | Sweden | 89/24 |
| 2149 | of 1871 | United Kingdom | 89/24 |
| 1411 | of 1886 | United Kingdom | 89/24 |
| 885361 | 12/1961 | United Kingdom | 89/24 |

*Primary Examiner*—Stephen M. Johnson
*Attorney, Agent, or Firm*—Oliff & Berridge

[57] ABSTRACT

A breech block has, for each cheek of a breech ring, at least one bearing surface facing a rear of the breech. The bearing surface is adjustable to slide along a paired bearing surface of a matching bearing element of the cheek and bears on the paired bearing surface to transfer strain to the cheek generated during firing of a round. The bearing surface of the breech block and the paired bearing surface of the cheek of the breech ring face each other so that the plane of each of the matched bearing surfaces intersects a plane defined by the axis of the barrel and a horizontal line along a half-line terminating at the axis. The half-line defines an angle greater than 90° with respect to the axis.

10 Claims, 3 Drawing Sheets

CANNON BREECH INCLUDING A BREECH BLOCK TRANSLATABLE BETWEEN TWO CHEEKS OF A BREECH RING, AND CANNON HAVING SUCH A CANNON BREECH

BACKGROUND OF THE INVENTION

The subject of the present invention is a cannon breech comprising a breech block that is mobile between the two cheeks of a breech ring.

Another subject of the invention is the cannon comprising such a breech.

Among the different known types of breech, the subject of the present invention is that of a cannon breech in which the breech block comprises on each of its sides and opposite the corresponding cheek of the breech ring at least one bearing element having at least one bearing surface paired with a matching bearing element of the cheek. In bearing upon the paired surface, strain generated during firing of a round is transmitted to the cheek.

In a very common embodiment, a simple bearing between the breech block and the breech ring is used. The breech block has on its rear face, on either side of this face, a bearing surface that is substantially perpendicular to the common axis of the barrel and the breech. The bearing surface also bears upon a bearing surface paired with the corresponding cheek of the breech ring. The plane of these surfaces intersects the plane defined by the axis of the barrel and the horizontal line following a perpendicular line to the axis.

When a round is fired, the combustion of the powder in the barrel chamber generates very high pressure gases that act both on the front face of the breech block, which closes when the breech is opened, and on the round that is thereby expelled at an extremely high velocity.

The pressure withstood by the breech block generates a load over the front face of the block wherein the resultant is located along the axis of the barrel and of the breech. This load is transmitted to the breech ring by the afore-mentioned bearing surfaces. In addition to the longitudinal traction strain, the lateral off-set of the bearing surfaces with respect to the neutral axis of each of the cheeks induces in each of the checks a bending moment that tends to force the cheeks apart from one another.

To avoid opening the cheeks of the breech ring under the action of this strain, the two cheeks are linked together by a brace located in the lower rear part of the ring. The brace fulfils another function in that it ensures the guidance of the round during loading of the round.

This structure has a great disadvantage because the useful bearing surface area of the breech on the cheek is limited, which also limits the strain that may be transmitted to the cheek and therefore limits the maximum pressure that may be generated inside the barrel. Moreover the problem of overall bulk prevents the cheeks from being increased in size, notably those following the axis of the barrel.

Another structure comprising several bearings so as to better spread the strain in the cheeks of the breech ring is known by document US-A-5014 592, where it is also known to eliminate the brace so as to facilitate machining of the ring.

In this event, a third bearing is required to reduce the opening of the cheeks of the breech ring if the brace is eliminated. This necessitates the breech block to be increased in size following the axis of the barrel, which may constitute a serious handicap in all cases where available space is very limited.

SUMMARY OF THE INVENTION

An aim of the present invention is to meet with the disadvantages of conventional breeches, and to propose a breech of the aforementioned type that has a minimal bulk so as to enable assembly in a small amount of space and at the same time is able to withstand very high pressures such as those envisaged for the new generation of tank artillery. Another aim of the invention is also to propose structure to ensure guidance of the round given that the brace, which conventionally links the breech ring cheeks together in the lower part of the cheeks has been eliminated.

According to the invention, the cannon breech of the aforementioned type is characterised in that the breech block bearing surface and the paired bearing surface of the corresponding cheek of the ring are directed in such a manner that the plane of each of the surfaces intersects the plane defined by the barrel axis and the horizontal line following a half-line stopping at the axis and together, with the half-line directed towards the front of the barrel, make an angle greater than 90°.

When a round is fired, the combustion of the powder in the chamber of the barrel produces very high pressure gases that exert a load spread over the front face of the breech block wherein the resultant is located on the axis of the barrel. The direction of the respective bearing surfaces of the breech block and the cheeks of the breech ring break this load down into a main component acting substantially in the same sense as the axis of the barrel and into a matching component that is perpendicular to the barrel, thus creating a strain that is opposed to the bending strain of the cheeks of the breech ring towards the outside induced by the off-set of the bearing surface of each cheek with respect to the neutral axis of the cheek.

Understandably, it is easy to choose for each case the surface area of the bearing surface and the value of the afore-mentioned angle to generate a bending strain towards the inside thus balancing the bending strain towards the outside. Each breech ring cheek is thus subjected substantially only to a traction strain in the sense of the barrel axis, thereby increasing the service life of the breech ring.

According to another aspect of the invention, the breech block may have at least two bearing surfaces in front of each of the cheeks of the breech ring that are adjusted so as to bear upon the paired bearing surfaces of the corresponding cheek of the breech ring.

The breech according to the invention may thus withstand very high pressure while preserving a very simple structure having no brace, and therefore is easy to machine and relatively economical, and remains compact.

According to another advantageous aspect of the invention, the angle made by the second bearing surface of the breech block located towards the rear of the breech with the half-axis in the sense of the front of the barrel may be greater than the angle corresponding to the first bearing surface of the breech block located to the front of the breech.

The bending strain directed towards the inside at the level of this second surface (rear) is thus greater that than exerted on the first surface, and corresponds to the higher value of the bending strain towards the outside exerted on the same surface.

According to another aspect of the invention, the distance between the two bearing surfaces of one side of the breech block may be slightly greater than the distance between the two corresponding paired surfaces of the cheek in question.

Other particularities and advantages of the invention will be made clearer from the detailed description hereafter.

BRIEF DESCRIPTION OF THE DRAWINGS

Preferred embodiments of the invention are described in the appended drawings, given merely by way of illustration and, wherein.

DETAILED DESCRIPTION OF PREFERRED EMBODIMENTS

Figure 1:
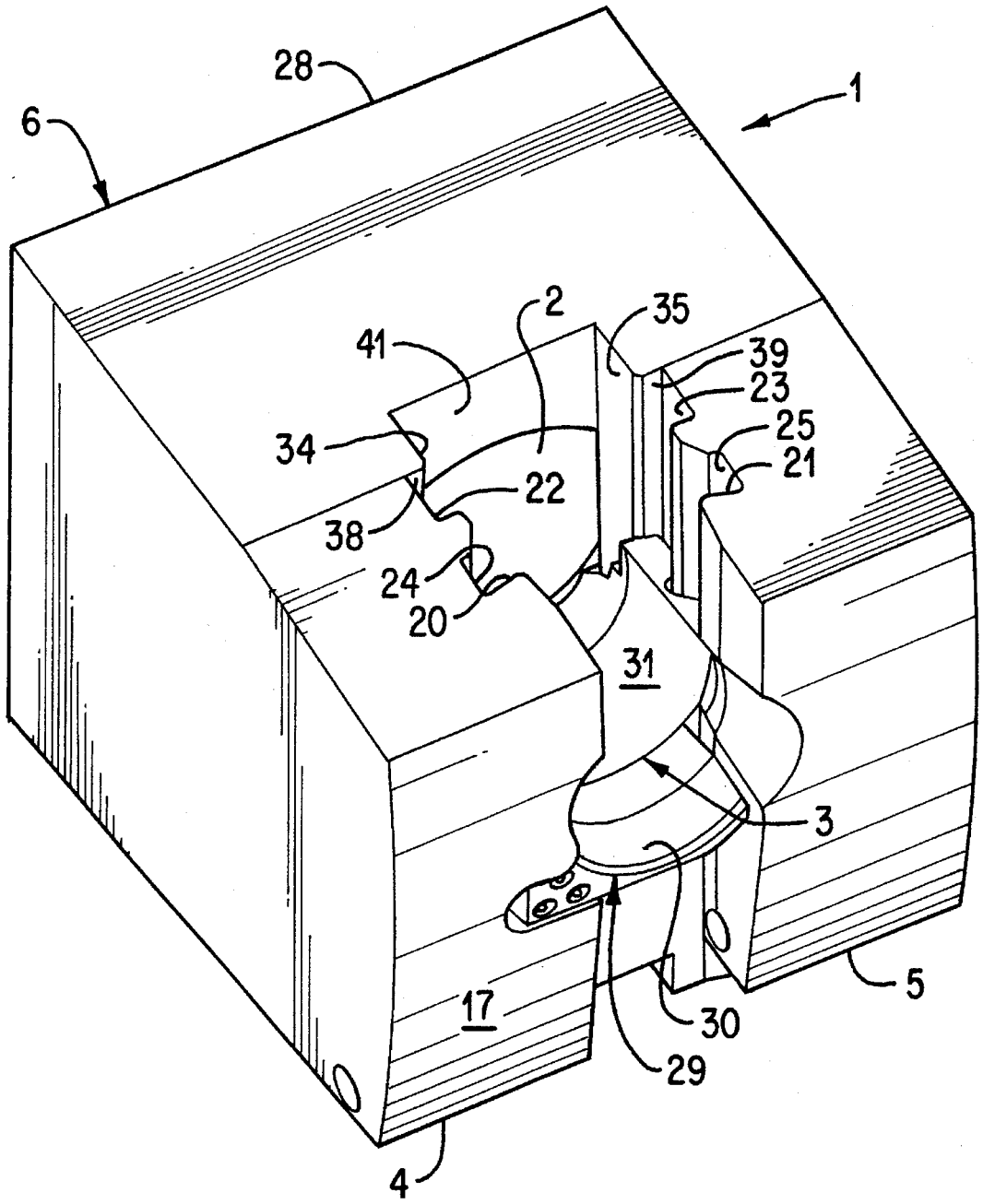
FIG. 1 is a perspective view of an embodiment of the cannon breech according to the invention.

In the embodiment shown in FIG. 1, the cannon breech 1 is in a perspective view taken from a point located towards the rear, above and to the left. The opening 2 of the breech 1 is adjusted to house a cannon barrel 40 represented in diagram form (FIGS. 2 and 4), the cannon barrel being screwed in place.

The cannon breech 1 comprises in a conventional manner a breech block 3 that is mobile between two cheeks 4, 5 of a breech ring 6. The breech block 3 is adjusted so as to slide in a substantially perpendicular plane to the axis of the barrel, between an open position, shown in the figure, in which the block 3 frees the opening 2 of the breech 1 so as to allow a round (not shown) to be inserted, and a high position (not shown) in which the said block 3 closes the opening 2, the opening already being blocked by the munition case.

Figure 2:
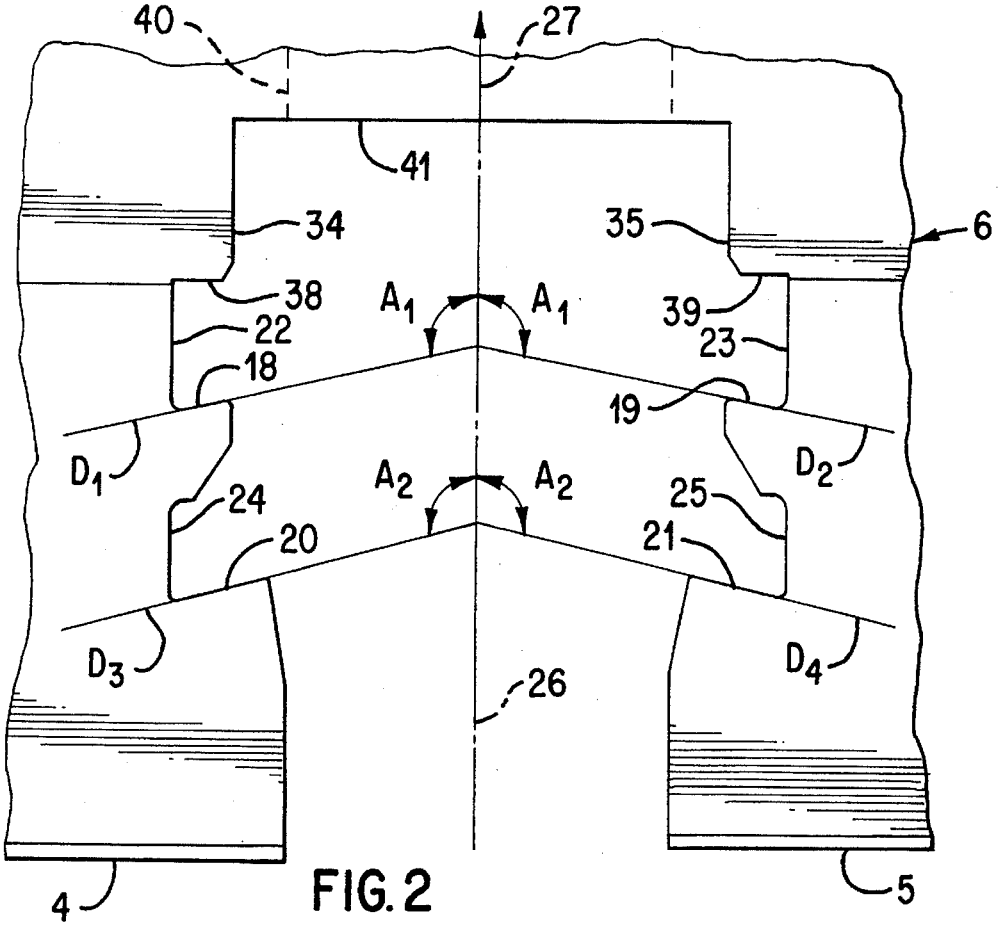
FIG. 2 is a partial enlarged top view of the rear part of the breech ring in FIG. 1, the breech block having been removed.
Figure 3:
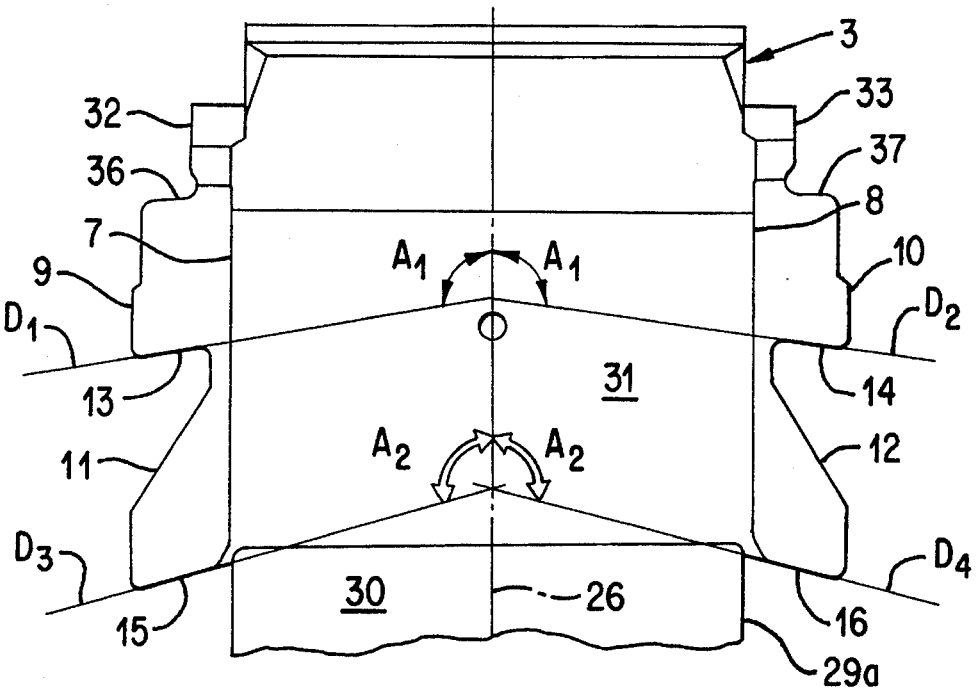
FIG. 3 is a top view similar to FIG. 2 of the breech block on its own.
Figure 4:
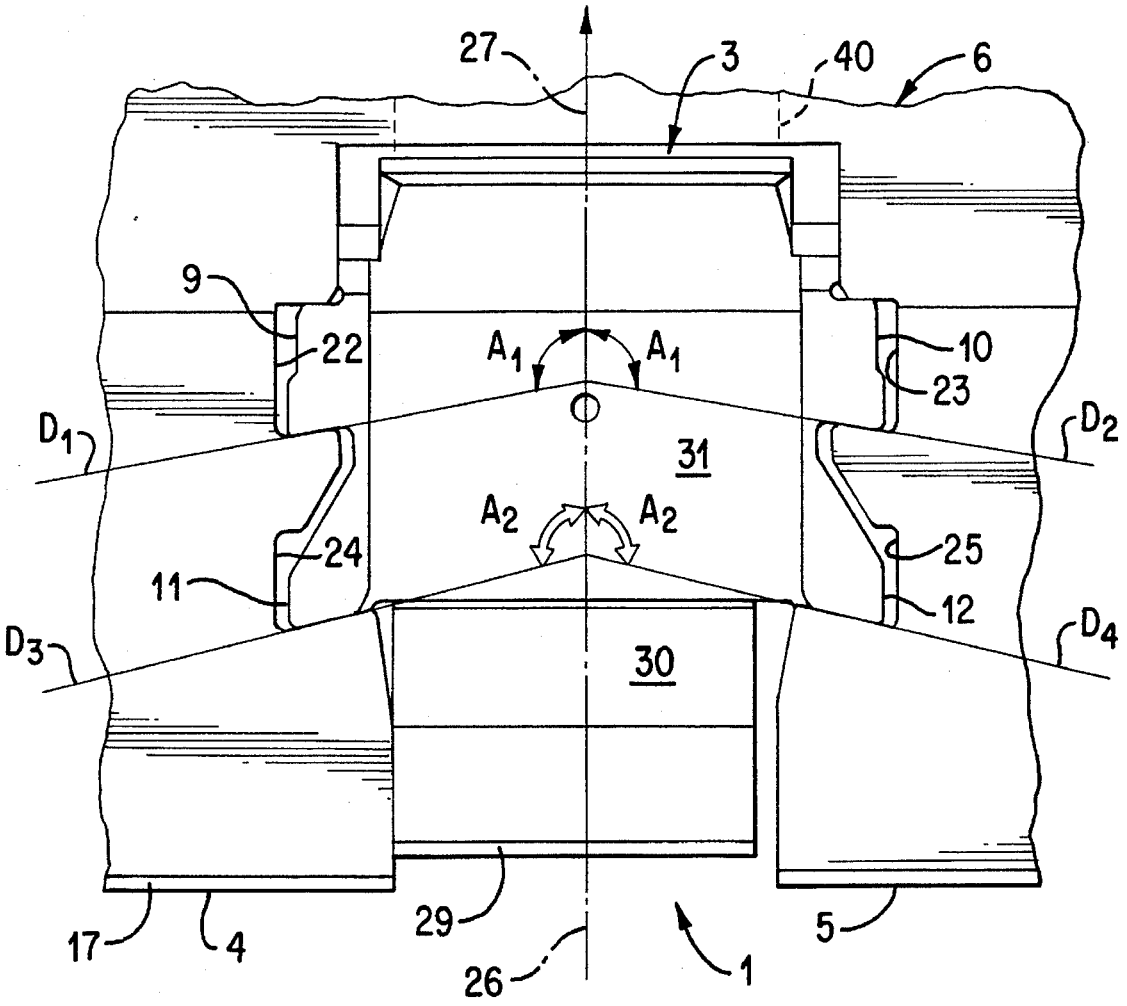
FIG. 4 is a top view similar to FIGS. 2 and 3 showing the breech block in position between the cheeks of the breech ring.

As may be seen in FIG. 1 and in detail in FIGS. 2 to 4, the breech block 3 comprises on each of its sides 7, 8 opposite the corresponding cheek 4, 5 of the ring 6, at least one bearing element 9, 10, 11, 12 having at least one bearing surface 13, 14, 15, 16 facing the rear 17 of the breech 1. The breech bearing surfaces are adjusted to slide along a paired bearing surface 18, 19, 20, 21 of a matching bearing surface 22, 23, 24, 25 of the cheek 4, 5, and bear on the paired surface 18, 19, 20, 21 to transfer to the cheek 4, 5 the strain generated during the Firing of a round.

According to the invention, each bearing surface 13, 14, 15, 16 of each said bearing element 9, 10, 11, 12 of the block 3 and each paired bearing surface 18, 19, 20, 21 of the corresponding cheek 4, 5 of the breech ring 6 face each other so that the plane of each of these surfaces 13, 14, 15, 16, 18, 19, 20, 21 intersects the plane of the figure defined by the axis 26 of the barrel and the horizontal line following a half-line D1, D2, D3, D4 stopping at the axis 26 and making together with the half-axis 27, in the sense of the front 28 of the breech and towards the front of the barrel, an angle A1, A2 of more than 90°.

In the example shown in the figures, the bearing elements 9, 10, 11, 12 of the breech block 3 are constituted from lateral protuberances 9, 10, 11, 12 projecting towards the outside of each side of the breech block 5. These protuberances are introduced into matching gliding channels 22, 25, 24, 25 arranged on the faces opposite the cheeks 4, 5 of the breech ring 6.

In the embodiment shown, the lateral protuberances 9, 10, 11, 12 are symmetrical to one another with respect to the vertical plane along the axis 26, and the gliding channels 22, 23, 24, 25 are symmetrical to one another with respect to the same plane.

The breech block 3 has therefore, in front of each of the cheeks 4, 5 of the breech ring 6, the first and second bearing surfaces, respectively 15, 15 and 14, 16 adjusted to bear on the paired bearing surfaces, respectively 18, 20 and 19, 21 of the cheeks 4, 5.

As shown in FIGS. 2, 3 and 4, the angle A2 made by the two half-lines D3 and D4 with the axis 26, which corresponds to the angle made by the two bearing surfaces 15, 16 of the breech block and 20, 21 of the breech ring 6 located towards the rear 17 of the breech with the vertical plane along the axis 26, is greater than the corresponding angle A1 made by the axis 26 and the first bearing surfaces 13, 14 of the breech block 3 and 18, 19 of the breech ring 6 located towards the front of the breech 1.

The bending moment in the sense of the axis 26 that is exerted on the second bearing surfaces (rear) 20, 21 of the cheeks 4, 5 is thus greater than the corresponding moment exerted on the first bearing surfaces (front) 18, 19 of these cheeks. It is easy to determine the angles A1 and A2 such that the relation between the bending moments is equal to the relation between the distances of these surfaces from the surface 41 of the breech 1 from which the cheeks 4 and 5 are constituted.

The distance between the two bearing surfaces 13, 15 or 14, 16 on either side of the breech block 3 is slightly greater than the distance between the two corresponding paired surfaces 18, 20 or 19, 21 of the cheek 4, 5 in question.

The second bearing surfaces 15, 16 of the breech block 3 are located to the rear of the breech blocks which are preferably, in their initial position, the only ones to come into contact with the respective paired surfaces 20, 21 of the breech ring 6. There is therefore a predetermined clearance between the first bearing surfaces 13, 14 of the block 3 located to the front of the block 3 and the respective paired bearing surfaces 18, 19 of the cheeks 4, 5 of the ring 6.

This predetermined clearance corresponds to a predetermined fraction of the elongation of the cheeks 4, 5 of the ring 6 in the sense of the axis 26 of the barrel upon firing of a round.

Thus, when a round is fired, the longitudinal strain transferred by the block 3 to the rear bearing surfaces 20, 21 of the cheeks causes the gradual elongation of the cheeks proportionate to the increase in gas pressure in the barrel chamber until the first bearing surfaces (front) 13, 14 of the block 3 come into contact with the front bearing surfaces 18, 19 of the cheeks 4, 5.

By positioning the respective bearing surfaces of the block 3 and the cheeks 4, 5 of the breech ring 6 to face as afore-mentioned, the presence of a brace in the lower rear part of the breech ring 6 is made redundant and therefore necessary. This notably allows the rear part of the breech to be made simpler.

The secondary function of the brace is to ensure that the round is correctly guided into place during its loading into the barrel.

To fulfil this secondary function of guiding the round during its insertion into the barrel, the breech according to the invention comprises, in addition, a guiding element 29*a*, 29 for a round located between the two cheeks 4, 5 of the breech ring 6 in the open position of the breech enabling a round to be inserted into the barrel.

In the example shown in FIG. 1, the guiding element 29 for a round is fitted onto one at least one (here, cheek 4) of the cheeks 4, 5 of the ring 6. An upper surface 30 is located substantially in the prolongation of the upper surface 31 of the breech block 3 when the block is in its open position, and has a concave shape that generally matches the concave shape of the surface 31.

In an alternative shown in FIG. 3, the guiding element 29*a* of the round is fitted to the rear of the breech block 3 and moves with the block. The element 29*a* may naturally comprise a single part with the breech block 3. The element 29*a* has, like element 29, the aforementioned upper surface 30.

In a conventional manner, the breech block 3 is also guided in its front part with respect to the cheeks 4, 5 of the breech ring 6.

The breech block 3 is guided laterally by means of its lateral surfaces 32 and 33, respectively located on the left part and on the right part of FIG. 2. The lateral surfaces, respectively, bear on the paired surfaces 34 and 35 of the cheeks 4 and 5 with the necessary clearance to enable these surfaces to slide smoothly against one another.

The protuberances 9 an 10 also have sliding surfaces turned towards the front and are generally parallel to the perpendicular plane of the axis 26. The sliding surfaces 36, 37 slide with an adequate clearance along the paired surfaces 38, 39 of the cheeks 4, 5.

A simple and economical breech structure without brace has thus been described that enables the bending moment tending to force the cheeks apart from one another during the firing of a round to be more or less eliminated, and prolongs the service life of the breech. The breech is able, with a single bearing surface on either side of the breech block, to transfer to the cheeks 4, 5 of the breech ring the longitudinal strain corresponding to conventional pressures reached in the chamber of a barrel during the firing of a round. With two bearing surfaces on either side of the breech block, such a breech is able to withstand and transfer strains corresponding to the higher pressures calculated for the new generation of tank artillery.

Naturally the invention is not limited to the embodiments herein described, and numerous changes and modifications may be brought to these embodiments without leaving the scope of the invention.

More than two bearing surfaces may thus be envisaged on the block and on the sliding elements of the cheeks of the breech ring. The bearing surfaces may well not be planar, or may correspond to planes that are not perpendicular to the axis 26 so as to exert a blocking effect of the breech block against the opening of the barrel.

It is understood that the number of bearing surfaces, the surface area of the surfaces and their inclination with respect to the vertical plane in the sense of the axis of the barrel may be defined at will in such a manner as to transfer to the cheeks 4 and 5 of the breech ring the strains calculated for the firing of a round, according to the pressure developed in the barrel chamber, in the practical absence of any bending strain of the cheeks towards the outside.

We claim:

1. A cannon breech comprising:

a breech ring having a rear portion having two cheeks and a front portion having a barrel disposed between the cheeks;

a breech block translatable between the cheeks of the breech ring, the breech block having on each side, opposite a corresponding cheek of the breech ring, at least one bearing element having at least one bearing surface facing a rear of the cannon breech, said at least one bearing element being slidable along a paired bearing surface of a matching bearing surface of the corresponding cheek and bearable on the paired bearing surface to transfer strain to the corresponding cheek generated during firing of a round, wherein the at least one bearing surface and the paired bearing surface of the corresponding cheek face each other so that corresponding planes defined by the at least one bearing surface on each side of the breech block and the paired bearing surface of each cheek intersect each other along an axis of the barrel to define corresponding angles of more than 90° with respect to the axis as measured between a portion of the axis forward of each of the corresponding planes and each corresponding plane, and wherein the at least one bearing surface includes first and second bearing surfaces each having a corresponding paired bearing surface, and further wherein a first angle of the first bearing surface of the breech block located toward the front of the cannon breech is less than a second angle made by the second bearing surface of the breech block located toward the rear of the breech.

2. A cannon breech according to claim 1, wherein the at least one bearing surface and the paired bearing surface are symmetrical with respect to a vertical plane along the axis of the cannon breech.

3. A cannon breech according to claim 1, wherein a distance between the first and second bearing surfaces on each side of the breech block is slightly greater than a distance between the paired bearing surfaces of the cheek.

4. A cannon breech according to claim 3, wherein only the second bearing surface of the breech block located to the rear of the breech block comes into contact with the corresponding paired bearing surface of the cheek of the breech ring, thereby creating a predetermined clearance between the first bearing surface of the breech block located to the front of the breech block and the respective paired bearing surface of the cheeks of the breech ring.

5. A cannon breech according to claim 4, wherein the predetermined clearance corresponds to a predetermined fraction of an elongation of each cheek of the breech ring along the axis of the barrel during firing of a round.

6. A cannon breech according to claim 1, further comprising a guiding element for a round located between the cheeks of the breech ring.

7. A cannon breech according to claim 6, wherein the guiding element for the round is fitted onto at least one of the cheeks.

8. A cannon breech according to claim 6, wherein the guiding element for the round is fitted to the breech block.

9. A cannon having a cannon breech comprising:

a breech ring having two cheeks and a barrel disposed between the cheeks;

a breech block translatable between the cheeks of the breech ring, the breech block having on each side, opposite a corresponding cheek of the breech ring, at least one bearing element having at least one bearing surface facing a rear of the cannon breech, said at least one bearing element being slidable along a paired bearing surface of a matching bearing surface of the corresponding cheek and bearable on the paired bearing surface to transfer strain to the corresponding cheek generated during firing of a round, wherein the at least one bearing surface and the paired bearing surface of the corresponding cheek face each other so that corresponding planes defined by the at least one bearing surface of each side of the breech block and the paired bearing surface of each cheek intersect each other along an axis of the barrel to define corresponding angles of more than 90° with respect to the axis as measured between a portion of the axis forward of each of the corresponding planes and each corresponding plane, and wherein the at least one bearing surface includes first and second bearing surfaces each having a corresponding paired bearing surface, and further wherein a first angle of the first bearing surface of the breech block located toward the front of the cannon breech is less than a second angle made by the second bearing surface of the breech block located toward the rear of the breech.

10. A cannon breech, comprising:

a breech ring having two cheeks;

a breech block having a longitudinal axis and being translatable between the cheeks of the breech ring, the breech block having on each side, opposite a corresponding cheek of the breech ring, at least first and second longitudinally spaced bearing elements having respective first and second bearing surfaces facing a rear of the cannon breech, each of said first and second bearing elements being slidable along a paired bearing surface of the corresponding cheek and bearable on the paired bearing surface, wherein each of the first and second bearing surfaces defines a corresponding plane that intersects a front portion of the longitudinal axis to form an angle of more than 90° as measured between a portion of the longitudinal axis forward of the corresponding plane and the corresponding plane, and wherein the planes defined by first and second bearing references, respectively, intersect each other along the longitudinal axis, and further wherein the plane defined by each first bearing surface is not parallel to a paired second bearing surface.

* * * * *